US009031446B2

(12) United States Patent
Cheong

(10) Patent No.: US 9,031,446 B2
(45) Date of Patent: May 12, 2015

(54) IMAGE FORMING APPARATUS

(71) Applicant: Samsung Electronics Co., Ltd., Suwon-si, Gyeonggi-do (KR)

(72) Inventor: Young Min Cheong, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 14/019,253

(22) Filed: Sep. 5, 2013

(65) Prior Publication Data

US 2014/0086612 A1 Mar. 27, 2014

(30) Foreign Application Priority Data

Sep. 26, 2012 (KR) ..... 10-2012-0107349

(51) Int. Cl.

*G03G 15/00* (2006.01)
*G03G 15/20* (2006.01)
*G03G 21/16* (2006.01)

(52) U.S. Cl.

CPC ..... *G03G 15/80* (2013.01); *G03G 15/2053* (2013.01); *G03G 21/1652* (2013.01); *G03G 21/1685* (2013.01)

(58) Field of Classification Search

CPC G03G 15/80; G03G 21/1652; G03G 21/1685
USPC ..... 399/90, 330
See application file for complete search history.

(56) References Cited

U.S. PATENT DOCUMENTS

| | | | | | |
|---|---|---|---|---|---|
| 5,532,807 | A * | 7/1996 | Takemoto | ..... | 399/335 |
| 5,826,152 | A * | 10/1998 | Suzuki et al. | ..... | 399/330 |
| 6,072,155 | A * | 6/2000 | Tomatsu | ..... | 399/333 |
| 6,101,363 | A * | 8/2000 | Tomatsu | ..... | 399/330 |
| 6,898,390 | B2 * | 5/2005 | Lee et al. | ..... | 399/88 |
| 2012/0155912 | A1 * | 6/2012 | Hayase et al. | ..... | 399/90 |

* cited by examiner

*Primary Examiner* — Ryan Walsh
(74) *Attorney, Agent, or Firm* — Staas & Halsey LLP

(57) ABSTRACT

An image forming apparatus is provided. The image forming apparatus includes a heating roller having an electrode to receive power disposed at an outer circumference thereof and a connection unit to supply the power to the heating roller via the electrode. The connection unit includes a connection member connected to the electrode, the connection member being rotated along with the heating roller, an annular friction bush disposed at the connection member, and at least one wire having one fixed end and the other end contacting an outer circumference of the friction bush. The connection member is rotated along with the heating roller, and therefore, no friction occurs between the electrode and the connection member, thereby preventing damage to the electrode.

18 Claims, 7 Drawing Sheets

IMAGE FORMING APPARATUS

CROSS-REFERENCE TO RELATED APPLICATIONS

This application is related to, and claims priority to, Korean Patent Application No. 10-2012-0107349, filed on Sep. 26, 2012 in the Korean Intellectual Property Office, the disclosure of which is incorporated herein by reference.

BACKGROUND

1. Field

Embodiments of the present invention relate to an image forming apparatus including a fusing unit to fuse a developing agent, transferred to printing media, on the printing media.

2. Description of the Related Art

An image forming apparatus forms an image on printing media according to an input signal. The image forming apparatus includes a printer, a copier, a facsimile and a multifunction device having functions of the printer, the copier, and the facsimile.

The image forming apparatus includes a paper supply unit to store printing media, a developing unit to supply toner to an electrostatic latent image such that the electrostatic latent image is developed into a visible image, an exposing unit to form an electrostatic latent image on a photoconductor of the charged developing unit, and a fusing unit to apply heat and pressure to printing media to which a developing agent has been transferred such that the developing agent is fused on the printing media.

The fusing unit includes a heating roller having a heater to generate heat disposed therein and a pressing roller to press printing media passing a space between the heating roller and the pressing roller toward the heating roller. The fusing unit may apply heat and pressure to printing media to which a developing agent has been transferred.

In recent years, there has been developed an image forming apparatus configured such that a heating belt formed of a surface type heat emitting body forms an outer circumference of the heating roller. Power may be supplied to the heating belt such that heat is uniformly generated throughout the outer circumference of the heating roller.

SUMMARY

It is an aspect of the present invention to provide an image forming apparatus wherein damage to an electrode provided at a heating roller is prevented.

Additional aspects of the invention will be set forth in part in the description which follows and, in part, will be obvious from the description, or may be learned by practice of the invention.

In accordance with an aspect of the present invention, an image forming apparatus includes a heating roller having an electrode to receive power disposed at an outer circumference thereof and a connection unit to supply the power to the heating roller via the electrode, wherein the connection unit includes a connection member connected to the electrode, the connection member being rotated along with the heating roller, an annular friction bush disposed at the connection member, and at least one wire having one fixed end and the other end contacting an outer circumference of the friction bush.

The heating roller may include a cylindrical roller body and a heating belt disposed at outer circumference of the roller body, the heating belt being formed of a surface type heat emitting body, the electrode may be formed in an annular shape and disposed at each side of the outer circumference of the roller body in contact with the heating belt, and the connection member may include a plurality of connection parts elastically supported by the electrode and arranged at intervals in a circumferential direction, each of the connection parts being formed of a leaf spring, and an annular joining part to join one ends of the connection parts to one another.

The connection member may include an annular bush installation part integrally formed at the joining part such that the friction bush is installed at an outer circumference of the bush installation part.

The friction bush may be integrally formed at the connection member and the connection parts may integrally extend from the friction bush.

The friction bush may be provided at the outer circumference thereof with at least one connection groove formed in a circumferential direction such that the other end of the wire is received in the connection groove in contact.

The at least one connection groove may include a plurality of connection grooves provided in parallel in an axial direction of the heating roller.

The at least one connection groove may have a V-shaped section.

The at least one wire may include a plurality of wires arranged in an inverse V shape to contact opposite sides of the friction bush.

The connection unit may include an electrode cover installed at each end of the heating roller to cover an outside of the electrode in a radial direction in a state in which the electrode cover is spaced apart from the electrode and the connection parts may be disposed between the electrode and the electrode cover through the electrode cover.

The wire and the friction bush may be formed of the same material.

Frictional regions of the wire and the friction bush may be plated with the same material.

Each of the connection parts may include a pair of auxiliary connection parts integrally extending therefrom.

The roller body may include a core having shafts provided at opposite sides thereof and a hollow cylindrical elastic member, in which the core is disposed, the elastic member being formed of an elastically deformable material, and the electrode and the heating belt may be disposed at an outer circumference of the elastic member.

Lubricant may be applied in the connection groove.

In accordance with an aspect of the present invention, an image forming apparatus includes a heating roller having an annular heating belt formed of a surface type heat emitting body and an annular electrode to receive power disposed at an outer circumference thereof and a connection unit to supply the power to the heating roller via the electrode, wherein the connection unit includes a connection member connected to the electrode, the connection member being rotated along with the heating roller, an annular friction bush disposed at the connection member, the friction bush being provided at an outer circumference thereof with a depressed connection groove formed in a circumferential direction, a plurality of wires having one fixed ends and the other ends connected to the connection groove, and an electrode cover to cover an outside of the electrode in a radial direction in a state in which the electrode cover is spaced apart from the electrode.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
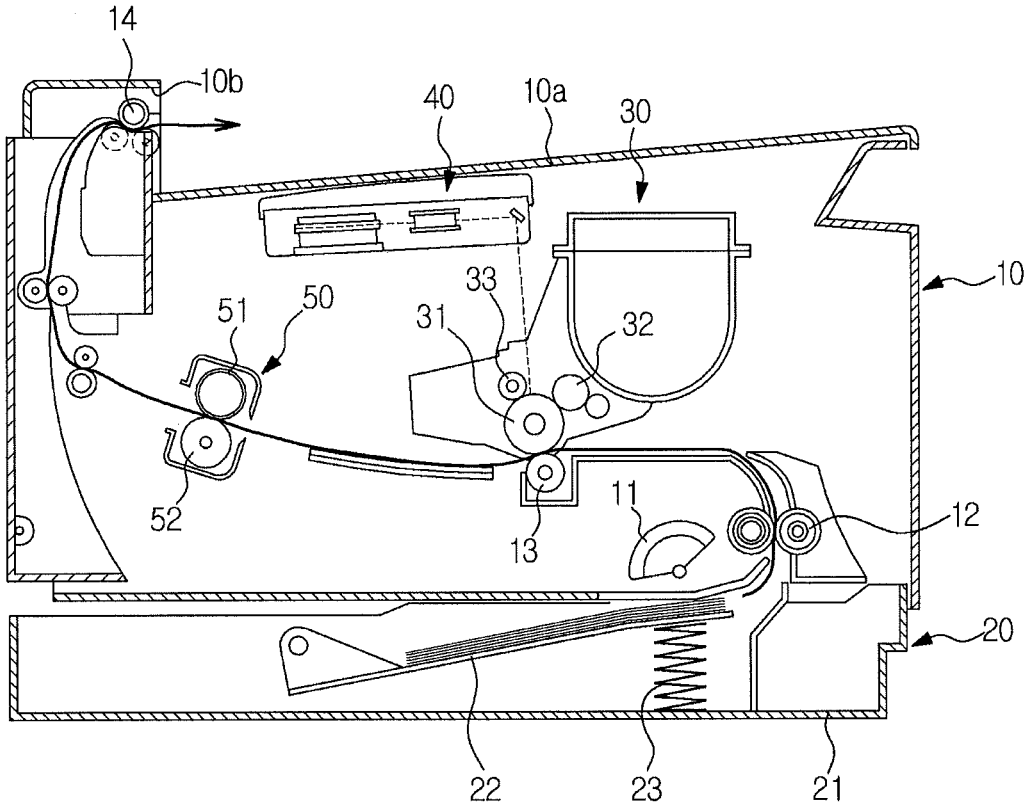
FIG. 1 is a sectional view of an image forming apparatus according to an embodiment of the present invention.

Reference will now be made in detail to the embodiments of the present invention, examples of which are illustrated in the accompanying drawings, wherein like reference numerals refer to like elements throughout.

As illustrated in FIG. 1, an image forming apparatus according to an embodiment of the present invention includes a main body 10 that may form the external appearance thereof, a paper supply unit 20 to store printing media, a developing unit 30 to supply a developing agent to an electrostatic latent image such that the electrostatic latent image is developed into a visible image, an exposing unit 40 to form an electrostatic latent image on a photoconductor of the charged developing unit 30, and a fusing unit to apply heat and pressure to printing media to which the developing agent has been transferred such that the developing agent is fused on the printing media.

The main body 10 may be provided at the top thereof with a loading part 10*a* on which printing media having images formed thereon are loaded. At one side of the loading part 10*a* may be provided a paper discharge port 10*b*, through which printing media having images formed thereon are discharged.

The paper supply unit 20 includes a paper supply cassette 21 detachably mounted in the main body 10, a knock-up plate 22 disposed in the paper supply cassette 21 to allow printing media to be loaded thereon, and an elastic member 23 to elastically support the knock-up plate 22.

The developing unit 30 includes a photoconductor 31 that may function as an image carrier carrying a visible image developed by a developing agent, an electrostatic latent image being formed on the surface of the photoconductor 31 by the exposing unit 40, a developing roller 32 to supply a developing agent to the photoconductor 31 such that the electrostatic latent image on the surface of the photoconductor 31 is developed into a visible image by the developing agent, and a charging roller 33 to charge the surface of the photoconductor 31.

The exposing unit 40 irradiates light containing image information to the photoconductor 31 of the developing unit 30 to form an electrostatic latent image on the surface of the photoconductor 31.

The fusing unit 50 includes a heating roller 51 having a heater to generate heat disposed therein, a pressing roller 52 to press printing media to the outer circumference of the heating roller 51, and a connection unit 53 connected to the heating roller 51 to supply power to the heating roller 51.

In the main body 10 may be mounted a pickup roller 11 that may be disposed above one side of the paper supply unit 20 to pick up printing media loaded on the knock-up plate 22 one by one, plural pairs of feeding rollers 12 to guide the printing media picked up by the pickup roller 11 to the developing unit 30 and the fusing unit 50 above the feeding rollers 12, a transfer roller 13 that may be disposed opposite to the photoconductor 31 to transfer a developing agent from the photoconductor 31 to printing media, and a paper discharge roller 14 that may be disposed above the fusing unit 50 so as to be adjacent to the paper discharge port 10*b* to discharge the printing media having passed through the fusing unit 50 through the paper discharge port 10*b*.

Figure 2:
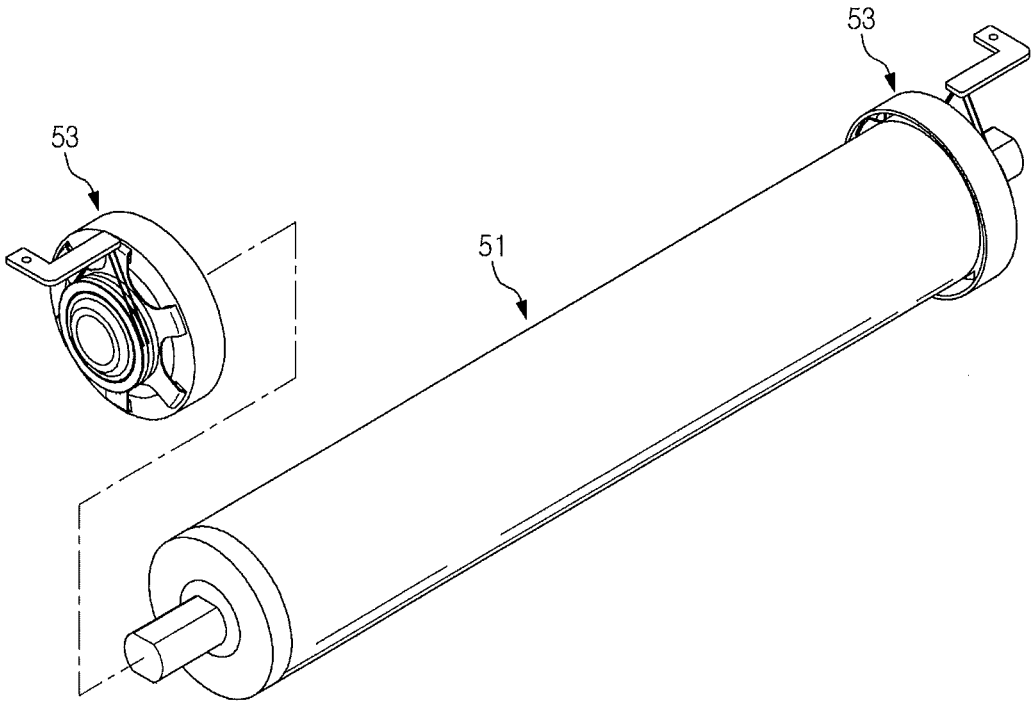
FIGS. 2 and 3 are exploded perspective views of a heating roller and a connection unit according to an embodiment of the present invention.
Figure 3:
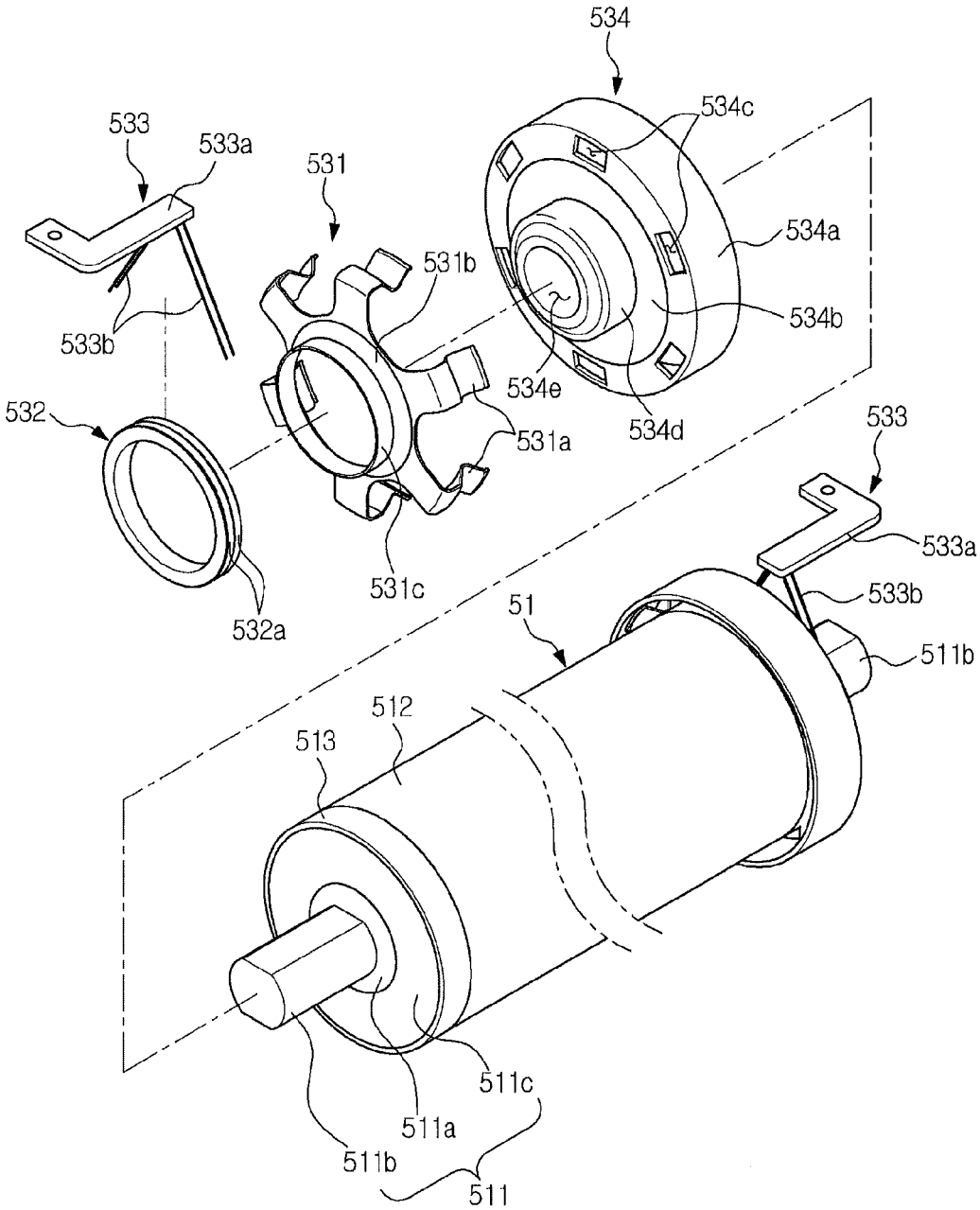
Figure 4:
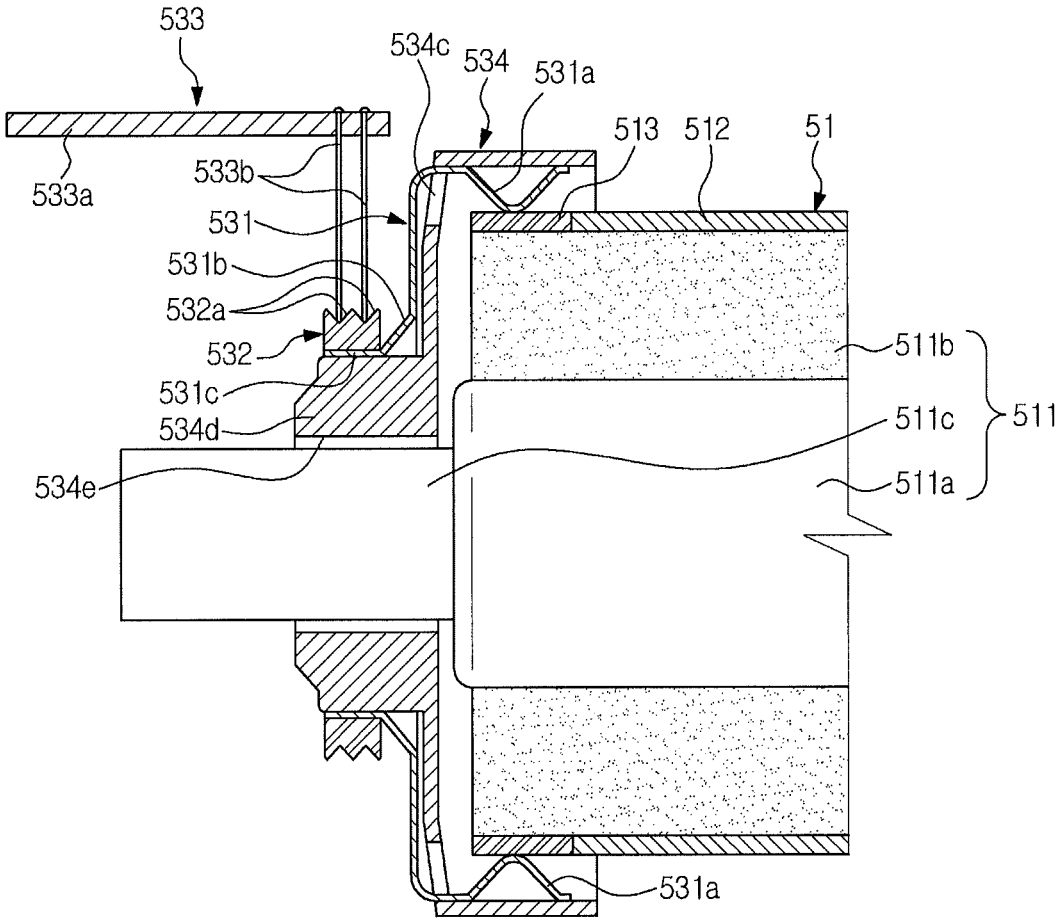
FIG. 4 is a sectional view of a heating roller and a connection unit according to the embodiment of the present invention.

As illustrated in FIGS. 2 to 4, the heating roller 51 of the fusing unit 50 includes a cylindrical roller body 511, a heating belt 512 that may be disposed on the outer circumference of the roller body 511 to generate heat, and a pair of annular electrodes 513 that may be disposed at opposite sides of the outer circumference of the heating roller 51 so as to be connected to the heating belt 512.

According to an exemplary embodiment, the roller body 511 includes a core 511*a* having shafts 511*b* provided at opposite sides thereof and a hollow cylindrical elastic member 511*c*, in which the core 511*a* may be disposed, the cylindrical elastic member 511*c* may be formed of an elastically deformable material. The heating belt 512 and the electrodes 513 may be disposed at the outer circumference of the elastic member 511*c*.

The connection unit 53 includes connection members 531 connected to the electrodes 513 and mounted at opposite ends of the heating roller 51 so as to be rotated together with the heating roller 51, annular friction bushes 532 disposed at the respective connection members 531, a plurality of wires 533*b* having one ends fixed to electrode plates 533*a* provided at the fusing unit 50 and the other ends disposed so as to be in contact with the outer circumferences of the friction bushes 532, and electrode covers 534 to cover the respective electrodes 513.

Each connection member 531 includes a plurality of connection parts 531*a* elastically supported by a corresponding one of the electrodes 513 and arranged at intervals in the circumferential direction, each of the connection parts 531*a* being formed of a leaf spring, an annular joining part 531*b* to join the connection parts 531*a* to one another, and an annular bush installation part 531*c* formed at the inner circumference of the joining part 531*b* such that a corresponding one of the friction bushes 532 is installed at the outer circumference of the bush installation part 531*c*.

Each friction bush 532 may be provided at the outer circumference thereof with a connection groove 532*a* provided in the circumferential direction so as to have a V-shaped section. The other ends of corresponding wires 533*b* may be received and connected in the connection groove 532*a*. According to an exemplary embodiment, lubricant to reduce friction between each friction bush 532 and corresponding wires 533*b* may be applied in the connection groove 532*a*.

The wires 533*b*, made of a metal material, may be arranged in an inverse V shape. The wires 533*b* may be connected to opposite sides of each friction bush 532.

During rotation of the heating roller 51, friction may occur between each friction bush 532 and corresponding wires 533*b* with the result that each friction bush 532 and the corresponding wires 533*b* may be worn. In order to reduce such wear, each friction bush 532 and the corresponding wires 533*b* may be made of the same metal or frictional regions of each friction bush 532 and the corresponding wires 533*b* may be plated with the same metal.

Each electrode cover 534 includes a cover part 534*a* disposed outside a corresponding one of the electrodes 513 in the radial direction so as to be spaced apart from the corresponding electrode 513, a side part 534*b* to cover a corresponding end of the heating roller 51, and a hub 534*d* provided at the center of the side part 534*b*, the hub part 534*d* having a shaft installation hole 534*e*, through which a corresponding one of the shafts 511*b* extends.

The connection parts 531 a of each connection member 531 may be disposed between the cover part 534*a* of a corresponding one of the electrode covers 534 and a corresponding one of the electrodes 513 through the side part 534*b*. A side part 534*b* may be provided with a plurality of through holes 534*c*, through which the connection parts 531*a* extend. The through holes 534*c* may be arranged at intervals in the circumferential direction.

When the connection parts 531*a* are disposed between the cover part 534*a* and a corresponding one of the electrodes 513, the connection parts 531*a* are supported by the inside of the cover part 534*a* such that the connection parts 531*a* are pressed toward the corresponding one of the electrodes 513. Consequently, the electrode covers 534 function to cover the electrodes 513 and, at the same time, to press the connection parts 531*a* toward the electrodes 513 such that a connection state between the connection parts 531*a* and the electrodes 513 is more stably maintained.

In a case in which the electrodes 513 are connected through the connection unit 53, the connection members 531 connected to the electrodes 513 are rotated along with the heating roller 51 when the heating roller 51 is rotated. As a result, no friction occurs between the electrodes 513 and the connection members 531, thereby preventing damage to the electrodes 513.

Figure 5:
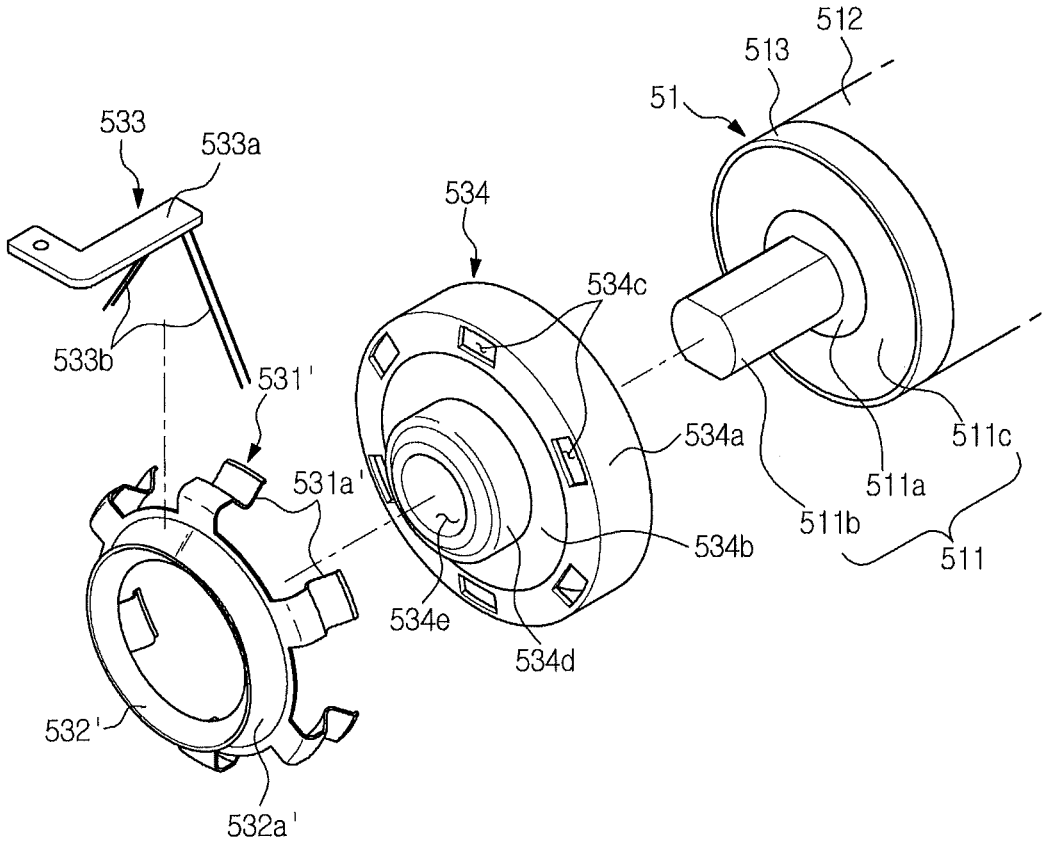
FIG. 5 is an exploded perspective view of a heating roller and a connection unit according to an embodiment of the present invention.
Figure 6:
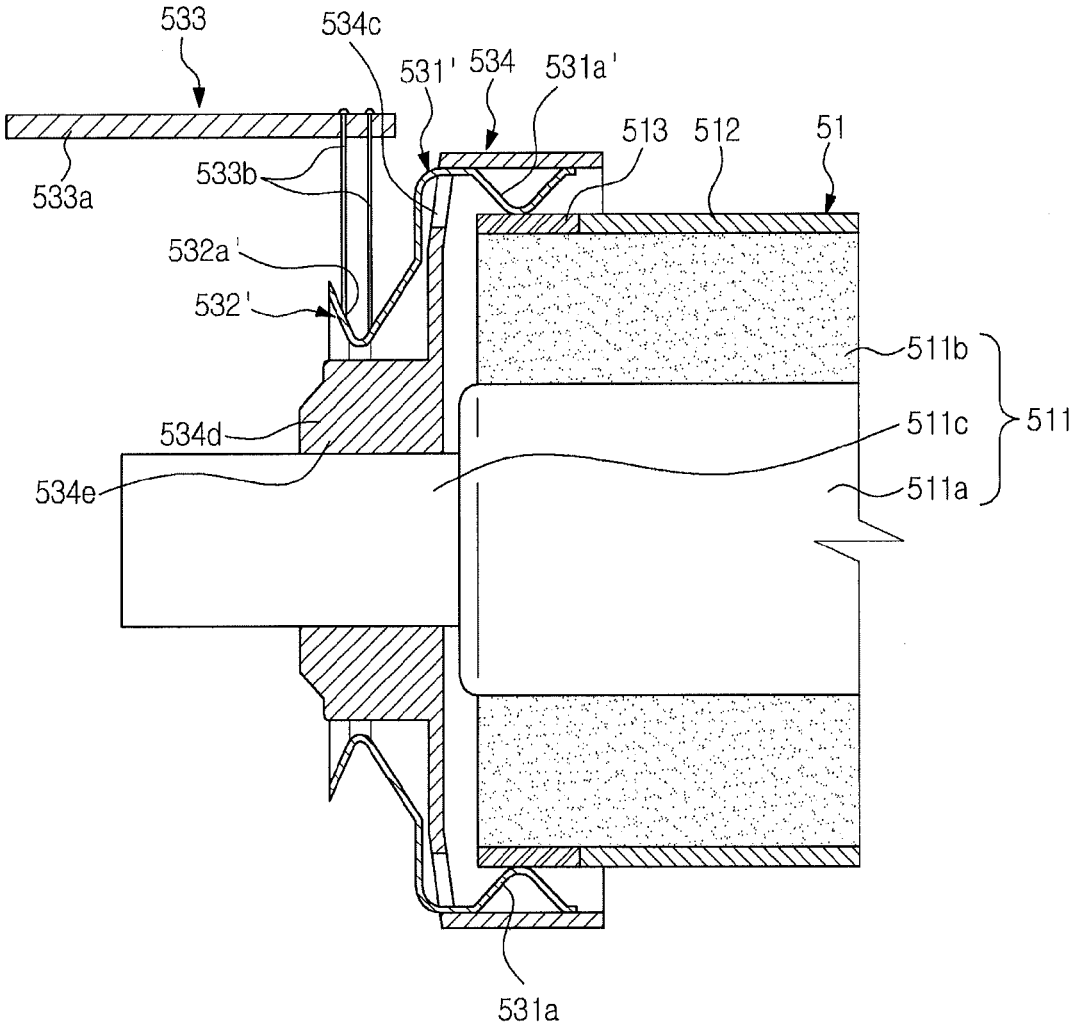
FIG. 6 is a sectional view of a heating roller and a connection unit according to the embodiment of the present invention.

According to an exemplary embodiment, the friction bushes 532 may be manufactured separately from the connection members 531 and then installed at the connection members 531, however, embodiments of the present invention are not limited thereto. As illustrated in FIGS. 5 and 6, a friction bush 532' may be integrally formed at a connection member 531'.

According to an exemplary embodiment, the friction bush 532' may be formed in an annular shape and has a connection groove 532*a*' formed in a V shape. The connection member 531' includes a plurality of connection parts 531*a*' that may be integrally extending from the friction bush 532', arranged at intervals in the circumferential direction, and elastically supported by an electrode 513 provided at a heating roller 51.

Figure 7:
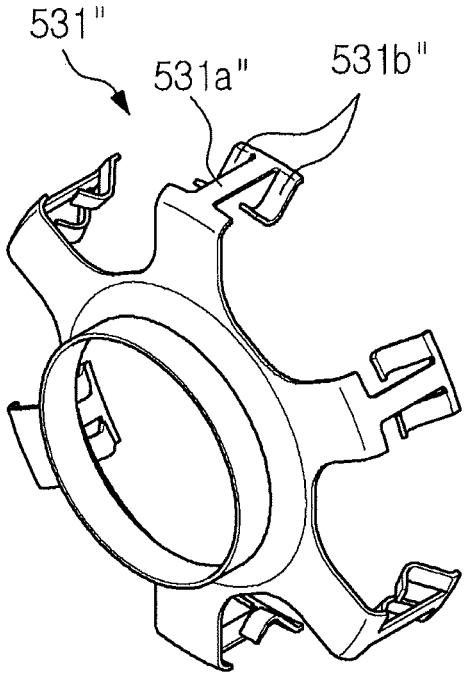
FIG. 7 is a perspective view of a connection member according to an embodiment of the present invention.

FIG. 7 is a perspective view of a connection member 531" applied to an image forming apparatus according to a an embodiment of the present invention.

As illustrated in FIG. 7, the connection member 531" includes a plurality of connection parts 531*a*" that may be arranged at intervals in the circumferential direction. Each connection part 531*a*" may be provided with a pair of auxiliary connection parts 531*b*" that may be integrally extending therefrom.

In a case in which a pair of auxiliary connection parts 531*b*" is formed at each connection part 531*a*", a total connection area with an electrode 513 is increased, thereby maintaining a more stable connection state between the electrode 513 and the connection member 531". An elastically deformable length of the connection member 531" may be increased by the provision of the auxiliary connection parts 531*b*". As a result, an elastically deformable width of the connection member 531" is increased, thereby maintaining a state in which the connection member 531" is more stably connected to the electrode 513.

As is apparent from the above description, the image forming apparatus according to the embodiment of the present invention is configured such that the connection members connected to the electrodes are rotated along with the heating roller, and therefore, no friction occurs between the electrodes and the connection members, thereby preventing damage to the electrodes.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a heating roller having an electrode to receive power disposed at an outer circumference thereof; and a connection unit to supply the power to the heating roller via the electrode, wherein the connection unit comprises a connection member connected to the electrode, the connection member being rotated along with the heating roller, an annular friction bush disposed at the connection member, and at least one wire having one fixed end and the other end contacting an outer circumference of the friction bush.

2. The image forming apparatus according to claim 1, wherein the heating roller comprises a cylindrical roller body and a heating belt disposed at outer circumference of the roller body, the heating belt being formed of a surface type heat emitting body, the electrode is formed in an annular shape and disposed at each side of the outer circumference of the roller body in contact with the heating belt, and the connection member comprises a plurality of connection parts elastically supported by the electrode and arranged at intervals in a circumferential direction, each of the connection parts being formed of a leaf spring, and an annular joining part to join one ends of the connection parts to one another.

3. The image forming apparatus according to claim 2, wherein the connection member further comprises an annular bush installation part integrally formed at the joining part such that the friction bush is installed at an outer circumference of the bush installation part.

4. The image forming apparatus according to claim 2, wherein the friction bush is integrally formed at the connection member, and the connection parts integrally extend from the friction bush.

5. The image forming apparatus according to claim 2, wherein the connection unit further comprises an electrode cover installed at each end of the heating roller to cover an outside of the electrode in a radial direction in a state in which the electrode cover is spaced apart from the electrode, and the connection parts are disposed between the electrode and the electrode cover through the electrode cover.

6. The image forming apparatus according to claim 2, wherein each of the connection parts comprises a pair of auxiliary connection parts integrally extending therefrom.

7. The image forming apparatus according to claim 2, wherein the roller body comprises a core having shafts provided at opposite sides thereof and a hollow cylindrical elastic member, in which the core is disposed, the elastic member being formed of an elastically deformable material, and the electrode and the heating belt are disposed at an outer circumference of the elastic member.

8. The image forming apparatus according to claim 1, wherein the friction bush is provided at the outer circumference thereof with at least one connection groove formed in a circumferential direction such that the other end of the wire is received in the connection groove in contact.

9. The image forming apparatus according to claim 8, wherein the at least one connection groove comprises a plurality of connection grooves provided in parallel in an axial direction of the heating roller.

10. The image forming apparatus according to claim 8, wherein the at least one connection groove has a V-shaped section.

11. The image forming apparatus according to claim 8, wherein lubricant is applied in the connection groove.

12. The image forming apparatus according to claim 1, wherein the at least one wire comprises a plurality of wires arranged in an inverse V shape to contact opposite sides of the friction bush.

13. The image forming apparatus according to claim 1, wherein the wire and the friction bush are formed of the same material.

14. The image forming apparatus according to claim 1, wherein frictional regions of the wire and the friction bush are plated with the same material.

15. An image forming apparatus comprising:

a heating roller having an annular heating belt formed of a surface type heat emitting body and an annular electrode to receive power disposed at an outer circumference thereof; and a connection unit to supply the power to the heating roller via the electrode, wherein the connection unit comprises a connection member connected to the electrode, the connection member being rotated along with the heating roller, an annular friction bush disposed at the connection member, the friction bush being provided at an outer circumference thereof with a depressed connection groove formed in a circumferential direction, a plurality of wires having one fixed ends and the other ends connected to the connection groove, and an electrode cover to cover an outside of the electrode in a radial direction in a state in which the electrode cover is spaced apart from the electrode.

16. The image forming apparatus according to claim 15, wherein the friction bush is integrally formed at the connection member.

17. The image forming apparatus according to claim 15, wherein the connection member comprises a plurality of connection parts elastically supported by the electrode and arranged at intervals in a circumferential direction, each of the connection parts being formed of a leaf spring, an annular joining part to join one ends of the connection parts to one another, and an annular bush installation part, at an outer circumference of which the friction bush is installed.

18. The image forming apparatus according to claim 17, wherein each of the connection parts comprises a pair of auxiliary connection parts integrally extending therefrom.

* * * * *